US009347181B2

(12) United States Patent
Lu et al.

(10) Patent No.: US 9,347,181 B2
(45) Date of Patent: May 24, 2016

(54) METHOD FOR INCREASING PAPER STRENGTH

(71) Applicant: KEMIRA OYJ, Helsinki (FI)

(72) Inventors: Chen Lu, Marietta, GA (US); Scott Rosencrance, Douglasville, GA (US); Danny Nguyen, Norcross, GA (US)

(73) Assignee: KEMIRA OYJ, Helsinki (FI)

( * ) Notice: Subject to any disclaimer, the term of this patent is extended or adjusted under 35 U.S.C. 154(b) by 0 days.

(21) Appl. No.: 14/087,038

(22) Filed: Nov. 22, 2013

(65) Prior Publication Data

US 2015/0144282 A1 May 28, 2015

(51) Int. Cl.

| | |
|---|---|
| ***D21H 11/00*** | (2006.01) |
| ***D21H 17/43*** | (2006.01) |
| ***D21H 17/37*** | (2006.01) |
| ***D21H 17/41*** | (2006.01) |
| ***D21H 21/10*** | (2006.01) |
| ***D21H 21/18*** | (2006.01) |
| ***D21H 21/20*** | (2006.01) |
| ***D21H 23/04*** | (2006.01) |
| ***D21H 23/22*** | (2006.01) |

(52) U.S. Cl.

CPC ..... *D21H 17/43* (2013.01); *D21H 17/375* (2013.01); *D21H 17/41* (2013.01); *D21H 21/10* (2013.01); *D21H 21/18* (2013.01); *D21H 21/20* (2013.01); *D21H 23/04* (2013.01); *D21H 23/22* (2013.01)

(58) Field of Classification Search

USPC ..... 162/164.5, 164.1, 164.6, 135, 158; 525/267, 329.1; 526/220, 217, 303.1

See application file for complete search history.

(56) References Cited

U.S. PATENT DOCUMENTS

| | | | |
|---|---|---|---|
| 3,556,932 | A | 1/1971 | Coscia et al. |
| 4,079,043 | A | 3/1978 | Rave |
| 4,233,411 | A | 11/1980 | Ballweber et al. |
| 4,297,860 | A | 11/1981 | Pacifici et al. |
| 4,605,702 | A | 8/1986 | Guerro et al. |
| 4,773,110 | A | 9/1988 | Hopkins |
| 8,435,382 | B2 | 5/2013 | Lu et al. |
| 2001/0051687 | A1 | 12/2001 | Bazaj et al. |
| 2009/0071618 | A1 | 3/2009 | Zhang et al. |
| 2009/0165978 | A1 | 7/2009 | Hagiopol et al. |
| 2010/0326615 | A1 | 12/2010 | Lu |
| 2011/0056640 | A1 | 3/2011 | Cyr et al. |
| 2012/0118523 | A1 | 5/2012 | Lu et al. |

FOREIGN PATENT DOCUMENTS

| | | | |
|---|---|---|---|
| WO | 01/49937 | A1 | 7/2001 |
| WO | 2006068964 | A3 | 6/2006 |
| WO | 2013179139 | A1 | 12/2013 |

OTHER PUBLICATIONS

Gaston County Dyeing Machine Co.; Foam Finishing Technology: The Controlled Application of Chemicals to a Moving Substrate; Clemson University, South Carolina; Dec. 1978; 4 pages.

Gaston County Dyeing Machine Company, Stanley, North Carolina; Christoph W. Aurich; Uniquenesses in Foam Application; 1992 Nonwovens Conference; 5 pages.

Werner Hartmann; Application Techniques for Foam Dyeing and Finishing; Eduard Kusters Corp.; Canadian Textile Journal, Apr. 1980; 4 pages.

International Search Report and Written Opinion dated Mar. 5, 2015; European Patent Office, Rijswijk; 10 pages.

*Primary Examiner* — Mark Halpern

(74) *Attorney, Agent, or Firm* — Thomas Horstemeyer, LLP

(57) ABSTRACT

The present invention provides a method for increasing paper strength in papermaking process comprising adding to a pulp a composition comprising an anionic polyacrylamide (APAM) and a high charge cationic glyoxylated polyacrylamide (GPAM). The present invention also provides paper obtained with said method.

13 Claims, No Drawings

METHOD FOR INCREASING PAPER STRENGTH

FIELD OF THE INVENTION

The present invention relates to compositions comprising an anionic polyacrylamide (APAM), and a high charge glyoxylated polyacrylamide (GPAM), and the use thereof for increasing paper strength in papermaking process.

BACKGROUND OF THE INVENTION

Paper sheets are made by dewatering a pulp suspension, forming a uniform web, and drying the web. During the papermaking process, various chemicals are commonly added to increase the productivity and also enhance paper physical properties. For example, retention/drainage aids are added to the pulp suspension to increase the pulp dewatering rate and also fix the anionic substances to the final paper sheet. Paper strength resins are also often introduced to increase paper dry strength and/or wet strength.

Glyoxylated polyacrylamide (GPAM) is generally used in a variety of paper grades to enhance the dry and temporary wet strength. It is used for example to increase the initial wet strength of many household tissues which come in contact with water in use. Glyoxylated polyacrylamide is also applied to increase the compression strength and the dimensional stability of many board-grade paper products.

Cationic glyoxalated polyacrylamide is a well-known strength resin that is often regarded as benchmark for generating dry strength. The polyacrylamide backbone normally incorporates a small amount of a cationic monomer, e.g. diallyldimethyl ammonium chloride (DADMAC), rendering the polymer self-retaining on fibers. GPAM is a reactive polymer that can covalently bind with cellulose upon dehydration.

U.S. Pat. No. 8,435,382 discloses a glyoxylated polymer obtained from the reaction between glyoxal and a cationic polyacrylamide base polymer comprising at least about 25% by weight cationic monomer. U.S. Pat. No. 8,435,382 also discloses a process of making paper which comprises absorbing an amount of the glyoxylated polyacrylamide polymer on cellulose papermaking fibers in aqueous suspension, forming said suspension into a water-laid web and drying said web, wherein the amount of glyoxylated polyacrylamide polymer is effective to increase at least one paper property selected from dry strength, wet strength, or de-water rate.

US2010/0326615 discloses a process for making paper comprising adding silicon-containing microparticles and a glyoxalated polyacrylamide polymer comprising at least about 25% by weight cationic monomer to an aqueous suspension containing cellulosic fibers, and forming said suspension into a water-laid web and drying said web to form paper. Before dewatering, the fiber suspension treated with the combination of GPAM polymers and silicon containing microparticles can have one or more optional additional additives mixed into the fiber suspension such as flocculants and coagulants.

US2011/0056640 discloses a process for improving drainage in paper making comprising adding an effective amount of a cationic GPAM to the aqueous suspension of cellulosic fibers, wherein the GPAM product is prepared using a base-polymer comprising greater than 10 mole-% of cationic monomer.

It would be beneficial to develop a chemical program to increase both papermaking retention/drainage rate and also paper strength properties. Such 2-in-1 program would simplify the management of chemicals significantly, resulting in less operator errors. In addition, such program would also lower the cost of chemicals and also the pumping equipment.

SUMMARY OF THE INVENTION

In the present invention it was surprisingly found out that when combining anionic PAM with high cationic charge glyoxylated polyacrylamide, paper strength can be enhanced significantly. In addition, this new program can also be applied to increase the production rate.

The conventional GPAM products generally contain less than 0.3 meq/g charges. As a result, only low amount of APAM can be applied, resulting in low paper strength and also weak retention/drainage performance. At higher APAM dosages, significantly higher GPAM dosages have to be applied to ensure the net cationic charge, leading to a high application cost. As a result, the conventional GPAM products are commonly applied in combination with a cationic polyacrylamide (CPAM) flocculant to boost retention/drainage.

In the present invention, GPAM products with high cationic charge densities were developed generally having cationic charge densities of over 0.4 meq/g, for example about 2.3 meq/g. The combination of an anionic polyacrylamide (APAM) and said high charge glyoxylated polyacrylamide (GPAM) provided significantly higher retention/drainage rates than the existing commercial programs for various types of pulp suspensions. As shown in the present invention, this new program also increased paper strength properties dramatically over the existing commercial product Fennobond 3000. The results also demonstrate that the present invention is particularly effective for the pulp suspensions containing high pH and high alkalinity where GPAM alone does not provide significant strength benefits.

The present invention provides a composition for increasing paper strength in papermaking process, said composition comprising an anionic polyacrylamide (APAM) and a high charge glyoxylated polyacrylamide (GPAM), wherein the high charge cationic glyoxylated polyacrylamide has a cationic charge density of over 0.4 meq/g.

The present invention also provides a method for increasing paper strength in papermaking process comprising: adding to a pulp suspension said composition comprising an anionic polyacrylamide (APAM) and a high charge glyoxylated polyacrylamide (GPAM), wherein the high charge cationic glyoxylated polyacrylamide has a cationic charge density of over 0.4 meq/g, and forming the pulp into paper.

The present invention also provides a process for making paper comprising adding to a pulp suspension said composition comprising an anionic polyacrylamide (APAM) and a high charge glyoxylated polyacrylamide (GPAM), wherein the high charge cationic glyoxylated polyacrylamide has a cationic charge density of over 0.4 meq/g, and forming the pulp into paper.

The present invention also provides a method for increasing paper strength in papermaking process comprising: adding to a dried paper sheet said composition comprising an anionic polyacrylamide (APAM) and a high charge glyoxylated polyacrylamide (GPAM), wherein the high charge cationic glyoxylated polyacrylamide has a cationic charge density of over 0.4 meq/g.

The present invention also provides a paper or pulp product obtained with said method.

The present invention provides several advantages. In the present invention the cationic GPAM forms aqueous complexes with anionic PAM through both electrostatic interaction and covalent bonding. In comparison, the conventional coagulants interact with anionic flocculants only through electrostatic interactions. The strong interaction between the cationic GPAM and the anionic PAM provides surprisingly superior retention/drainage performance over the conventional retention programs.

The present invention demonstrates that a net cationic charge is preferred to achieve good retention/drainage performance. Furthermore, a lower GPAM dosage is required to achieve comparable or better retention/drainage performance if the charge density of the GPAM is higher. The invention may be utilized in most of the paper grades, for example in tissue papers, packaging and board, newsprint, and printing/writing papers, to improve tensile, burst and surface strength.

It is another advantage of the present invention that it increases both paper dry strength and wet strength. Consequently, this invention eliminates the need to add another strength resin, resulting in cost reduction and also operation simplification.

It is another advantage of the present invention that it is particularly effective for the recycled furnishes containing high filler contents and high alkalinity levels.

DETAILED DESCRIPTION OF THE INVENTION

Generally a cationic glyoxylated polyacrylamide is prepared by reacting glyoxal with a cationic polyacrylamide basepolymer in slightly alkaline aqueous solution and stabilizing under acidic conditions. This method is known to a person skilled in the art and it is explained for example in the cited documents, which are all incorporated herein by reference. The high charge glyoxylated polyacrylamide of the present invention may be obtained with said method.

The "high charge" glyoxylated polyacrylamide as used herein refers to GPAM products having high cationic charge densities over 0.4 meq/g. In one example the high cationic charge density is in the range of about 0.4-5.0 meq/g. In one example the high cationic charge density is in the range of about 0.6-5.0 meq/g. In one example the high cationic charge density is in the range of about 0.6-4.0 meq/g. In one example the high cationic charge density is in the range of about 0.8-3.5 meq/g. In one example the high cationic charge density is in the range of about 1-3 meq/g.

The cationic glyoxylated polyacrylamide comprises cationic monomers and acrylamide monomers. The amount of the cationic monomer in the cationic polyacrylamide basepolymer may be in the range of 10-90% by weight. In one example the cationic polyacrylamide basepolymer contains about 20-70% by weight of the cationic monomer. The cationic glyoxylated polyacrylamide may comprise only one type of cationic monomers, or it may comprise more than one type of cationic monomers.

The amount of acrylamide monomer in the cationic GPAM may be in the range of 20-90% by weight. In one example the cationic GPAM contains about 30-80% by weight of the acrylamide monomer. The acrylamide may be acrylamide or another primary amine-containing monomer, such as methacrylamide, ethylacrylamide, N-ethyl methacrylamide, N-butyl methacrylamide or N-ethyl methacrylamide or combinations thereof.

The cationic monomer may be any suitable cationic monomer generally used in such cationic glyoxylated polyacrylamides. General examples of cationic monomers include allyl amine, vinyl amine, dialkylaminoalkyl acrylates and methacrylates and their quaternary or acid salts, including, but not limited to, dimethylaminoethyl acrylate methyl chloride quaternary salt (DMAEA.MCQ), dimethylaminoethyl acrylate methyl sulfate quaternary salt, dimethyaminoethyl acrylate benzyl chloride quaternary salt, dimethylaminoethyl acrylate sulfuric acid salt, dimethylaminoethyl acrylate hydrochloric acid salt, dimethylaminoethyl methacrylate methyl chloride quaternary salt, dimethylaminoethyl methacrylate methyl sulfate quaternary salt, dimethylaminoethyl methacrylate benzyl chloride quaternary salt, dimethylaminoethyl methacrylate sulfuric acid salt, dimethylaminoethyl methacrylate hydrochloric acid salt, dialkylaminoalkylacrylamides or methacrylamides and their quaternary or acid salts such as acrylamidopropyltrimethylammonium chloride, dimethylaminopropyl acrylamide methyl sulfate quaternary salt, dimethylaminopropyl acrylamide sulfuric acid salt, dimethylaminopropyl acrylamide hydrochloric acid salt, methacrylamidopropyltrimethylammonium chloride, dimethylaminopropyl methacrylamide methyl sulfate quaternary salt, dimethylaminopropyl methacrylamide sulfuric acid salt, dimethylaminopropyl methacrylamide hydrochloric acid salt, diethylaminoethylacrylate, diethylaminoethylmethacrylate, diallyldiethylammonium chloride. Alkyl groups may be $C_{1-4}$ alkyl.

In one example the monomer is selected from diallyl dimethyl ammonium chloride (DADMAC), 2-vinylpyridine, 4-vinylpyridine, 2-methyl-5-vinyl pyridine, 2-vinyl-N-methylpyridinium chloride, p-vinylphenyltrimethylammonium chloride, p-vinylbenzyltrimethyammonium chloride, 2-(dimethylamino)ethyl methacrylate, trimethyl(p-vinylbenzyl)ammonium chloride, p-dimethylaminoethylstyrene, dimethylaminopropyl acrylamide, 2-methylacroyloxyethyltrimethyl ammonium methylsulfate, 3-acrylamido-3-methylbutyl trimethyl ammonium chloride, 2-(dimethylamino)ethyl acrylate, [2-(acrylamido)ethyl]trimethylammonium chloride, [2-(methacrylamido)ethyl]trimethylammonium chloride, [3-(acrylamido)propyl]-trimethylammonium chloride, [3-(methacrylamido)propyl]trimethylammonium chloride, N-methyl-2-vinylpyridinium, N-methyl-4-vinylpyridinium, [2-(acryloyloxy)ethyl]trimethylammonium chloride, [2-(methacryloyloxy)ethyl]-trimethylammonium chloride, [3-(acryloyloxy)propyl]trimethylammonium chloride, [3-(methacryloyloxy)propyl]trimethylammonium chloride and combinations thereof. In one specific example the monomer is diallyl dimethyl ammonium chloride (DADMAC).

If the molecular weight of the cationic polyacrylamide is either too high or too low, the paper strength tends to deteriorate. In one example the cationic polyacrylamide base polymer of the high charge glyoxylated polyacrylamide has a molecular weight in the range of 500-1 000 000 Daltons. In one example the cationic polyacrylamide base polymer of the high charge glyoxylated polyacrylamide has a molecular weight in the range of 1000-100 000 Daltons. In one example the cationic polyacrylamide base polymer of the high charge glyoxylated polyacrylamide has a molecular weight in the range of 2000-30 000 Daltons. In one example the cationic polyacrylamide base polymer of the high charge glyoxylated polyacrylamide has a molecular weight in the range of 3000-20 000 Daltons. In one example the cationic polyacrylamide base polymer of the high charge glyoxylated polyacrylamide has a molecular weight in the range of 5000-15 000 Daltons.

In one example the GPAM may be present in an amount of 0.01-2% by weight of dry pulp. In one example the APAM may be present in an amount of 0.01-1% by weight of dry pulp. The GPAM to APAM ratio may be in the range of 0.01:1-1:0.01. In one example the GPAM to APAM ratio is in the range of 0.1:1-1:0.1. In one example the GPAM to APAM ratio is about 1:1.

The anionic polyacrylamides (APAM) are copolymers of acrylamides and anionic monomers. Examples of the anionic monomers include acrylic acid, and its salts, for example sodium acrylate, and ammonium acrylate, methacrylic acid, and its salts, for example sodium methacrylate, and ammonium methacrylate, 2-acrylamido-2-methylpropanesulfonic acid (AMPS), the sodium salt of AMPS, sodium vinyl sulfonate, styrene sulfonate, maleic acid, and its salts, for example the sodium salt, and ammonium salt, sulfonate, itaconate, sulfopropyl acrylate or methacrylate or other water-soluble or dispersable forms of these or other polymerisable carboxylic or sulfonic acids, or combinations thereof.

In one example the anionic polyacrylamide has a molecular weight in the range of 500-60 000 000 Daltons. In one example the anionic polyacrylamide has a molecular weight in the range of 500-30 000 000 Daltons. In one example the anionic polyacrylamide has a molecular weight in the range of 1000-1 000 000 Daltons. In one example the anionic polyacrylamide has a molecular weight in the range of 100 000-500 000 Daltons. In one example the anionic polyacrylamide has a molecular weight of about 300 000 Daltons. The anionic polyacrylamide may have a charge density in the range of about −1-2 meq/g, such as for example about −1.3 meq/g.

The composition is generally present as an aqueous solution, which may contain at least 10% (w/w) of the composition comprising the APAM and the GPAM. In one example the aqueous solution contains at least 25% (w/w) of the composition comprising the APAM and the GPAM. Because the APAM and GPAM react instantly upon mixing and the formed composition may not be stable, the composition is usually prepared instantly before use. In one example the composition is prepared in situ. In another example the composition is prepared on site. "On site" means that the preparation is carried out separately from the target application of the composition, and the composition obtained will be brought promptly to the target after preparation. In situ means "in the reaction mixture", for example in the treatment process.

In one specific example the composition does not contain other components besides said APAM and said GPAM in the aqueous solution, i.e. the composition consists of said APAM and said GPAM in the aqueous solution.

The present invention is particularly effective for the pulp suspensions containing high pH and high alkalinity. The high pH refers to a pH of over 6.5, for example pH of at least 7.0, or at least 7.5. The high alkalinity refers to alkali concentration of at least 30 ppm, such as over 60 ppm, for example at least over 90 ppm.

Said composition comprising the combination of APAM and GPAM may be added to the pulp or paper, for example to pulp suspension, at any suitable location, for example at any suitable wet end location, to produce a paper or pulp product with increased strength. The pulp suspension may also be called pulp slurry. The composition may be added to the papermaking process at any point where such strength additives are generally added. The composition is preferably added as an aqueous solution. The composition may be added at any time before, during or after the paper is formed. Examples of such time points or locations include before or after refining the pulp, at the fan pump, before or at the head box, or by spraying, printing, coating or impregnating on the web, to preformed paper, for example by tub sizing, or on the dried paper sheets, for example by spraying. The "strength system" as used herein generally refers to said composition and variants thereof.

In an exemplary embodiment the method comprises adding the composition to a pulp slurry or suspension, which may be used to produce a paper product. As a result, the strength system is dispersed throughout the resultant paper product.

In an exemplary embodiment the method comprises the steps of forming an aqueous suspension of cellulosic fibers, such as pulp, adding an amount of the composition to said suspension, forming the cellulosic fibers into a sheet and drying the sheet to produce a paper.

In an exemplary embodiment the method comprises adding or applying the composition to a preformed or dried paper sheet.

In an exemplary embodiment of a strength system including GPAM and APAM, the individual components may be combined first and then applied to a web or fibers, or the two components may be applied simultaneously or sequentially in either order.

After the two components have been applied to the web, the web or fibers are dried and heatedly sufficiently to achieve the desired interaction between the two compounds.

By way of example only, application of the strength system (or a component thereof) can be applied by any of the following methods or combinations thereof. In an exemplary embodiment, the method can include direct addition of the strength system (or a component thereof) to a fibrous slurry, such as by injection of the compound into a slurry prior to entry in the headbox. In an exemplary embodiment, the slurry can be about 0.1% to about 50% by weight, about 0.2% to 10%, about 0.3% to about 5%, or about 0.4% to about 4%.

In an exemplary embodiment, the method can include spraying the strength system (or a component thereof) to a fibrous web. For example, spray nozzles may be mounted over a moving paper web to apply a desired dose of a solution to a web that can be moist or substantially dry.

In an exemplary embodiment, the method can include application of the strength system (or a component thereof) by spray or other means to a moving belt or fabric, which in turn contacts the tissue web to apply the chemical to the web, such as is disclosed in WO 01/49937.

In an exemplary embodiment, the method can include printing the strength system (or a component thereof) onto a web, such as by offset printing, gravure printing, flexographic printing, ink jet printing, digital printing of any kind, and the like.

In an exemplary embodiment, the method can include coating the strength system (or a component thereof) onto one or both surfaces of a web, such as blade coating, air knife coating, short dwell coating, cast coating, and the like.

In an exemplary embodiment, the method can include extrusion from a die head of the strength system (or a component thereof) in the form of a solution, a dispersion or emulsion, or a viscous mixture.

In an exemplary embodiment, the method can include application of strength system (or a component thereof) to individualized fibers. For example, comminuted or flash dried fibers may be entrained in an air stream combined with an aerosol or spray of the compound to treat individual fibers prior to incorporation into a web or other fibrous product.

In an exemplary embodiment, the method can include impregnation of a wet or dry web with a solution or slurry of strength system (or a component thereof), where the strength system (or a component thereof) penetrates a significant distance into the thickness of the web, such as about 20% or more of the thickness of the web, about 30% or more, and about 70% or more of the thickness of the web, including completely penetrating the web throughout the full extent of its thickness.

In an exemplary embodiment, the method for impregnation of a moist web can include the use of the Hydra-Sizer® system, produced by Black Clawson Corp., Watertown, N.Y., as described in "New Technology to Apply Starch and Other Additives," Pulp and Paper Canada, 100(2): T42-T44 (February 1999). This system includes a die, an adjustable support structure, a catch pan, and an additive supply system. A thin curtain of descending liquid or slurry is created which contacts the moving web beneath it. Wide ranges of applied doses of the coating material are said to be achievable with good runnability. The system can also be applied to curtain coat a relatively dry web, such as a web just before or after creping.

In an exemplary embodiment, the method can include a foam application of the strength system (or a component thereof) to a fibrous web (e.g., foam finishing), either for topical application or for impregnation of the additive into the web under the influence of a pressure differential (e.g., vacuum-assisted impregnation of the foam). Principles of foam application of additives such as binder agents are described in the following publications: F. Clifford, "Foam Finishing Technology: The Controlled Application of Chemicals to a Moving Substrate," *Textile Chemist and Colorist,* Vol. 10, No. 12, 1978, pages 37-40; C. W. Aurich, "Uniqueness in Foam Application" Proc. 1992 *Tappi Nonwovens Conference*, Tappi Press, Atlanta, Geogia, 1992, pp. 15-19; W. Hartmann, "Application Techniques for Foam Dyeing & Finishing", *Canadian Textile Journal*, April 1980, p. 55; U.S. Pat. No. 4,297,860, and U.S. Pat. No. 4,773,110, each of which is herein incorporated by reference.

In an exemplary embodiment, the method can include padding of a solution containing the strength system (or a component thereof) into an existing fibrous web.

In an exemplary embodiment, the method can include roller fluid feeding of a solution of strength system (or a component thereof) for application to the web.

When applied to the surface of a paper web, an exemplary embodiment of the present disclosure may include the topical application of the paper strength system (e.g., the PAE polymer and, optionally the aldehyde-functionalized polymer resin) can occur on an embryonic web prior to Yankee drying or through drying, and optionally after final vacuum dewatering has been applied.

The method of the present invention may be applied to any kind of papermaking processes. All suitable kinds and grades of papers are included, such as Kraft paper, sulfite paper, semichemical paper, and the like, including paper produced using bleached pulp, unbleached pulp, or combinations thereof.

Also, any suitable kind of pulp may be treated with the method of the invention. These include for example virgin and/or recycled pulp, such as virgin sulfite pulp, broke pulp, a hardwood kraft pulp, a softwood kraft pulp, old corrugated containers (OCC), mixtures of such pulps, and the like. Also any mechanical pulping method may be applied, for example thermomechanical pulp (TMP), stone groundwood (SOW), or chemithermomechanical pulp (CTMP). Different types of pulp require different types of paper although many papers can use a combination or "blend" of several different types of pulp and recycled/recovered paper. Generally the pulp refers to an aqueous suspension containing cellulose fibers.

The present invention also provides a paper or pulp product obtained with the method described herein. The product may be for example paper sheeting, paperboard, tissue paper, or wall board. Paper products include for example all grades of paper, newsprint, linerboard, fluting medium, and Kraft, and other paper materials. Specific examples of the tissue papers include hygienic tissue paper, facial tissues, paper towels, wrapping tissue, toilet tissue, table napkins and the like. The paper or pulp product obtained with the method of the invention may be distinguished from any other paper or pulp products by analyzing the content of APAM and GPAM in the product.

Next the invention is illustrated by the following examples, wherein diallyl dimethyl ammonium chloride was used as the cationic monomer for the GPAM and Fennobond 85 was used as the APAM. The general concept explained in the examples may be applied to other types of GPAMs and APAMs as well.

EXAMPLES

Glyoxalated Polyacrylamide Samples

High charge glyoxalated polyacrylamide (GPAM) sample was prepared by the crosslinking reaction between a poly (acrylamide-co-dimethyldiallylammonium chloride) basepolymer and glyoxal as discussed in U.S. Pat. Nos. 3,556,932, 4,605,702 and 8435382 and US Patent Application 20090071618. Table 1 shows the properties of the GPAM sample.

TABLE 1

GPAM properties

| Samples | Basepolymer Mw (Da) | Basepolymer DADMAC content (wt%) | GPAM active contents (wt%) | GPAM viscosity (cps) | GPAM charge density (meq/g) |
|---|---|---|---|---|---|
| Sample 1 Fennobond 3000 | NA | 10 | 7 | 20 | +0.3 |
| GPAM Sample 2 | 10000 | 58 | 14 | 22 | +2.3 |

Anionic Polyacrylamide

FENNOBOND 85 is a commercial anionic polyacrylamide with a molecular weight of about 300 000 Daltons and a charge density around −1.3 meq/g.

Charge Titration

All strength resins were first diluted to 1.0% by weight using di-ionized water and pH was adjusted to 7.0 using dilute HCl or NaOH. Afterwards, 0.5 g of the diluted strength resin and 9.5 g of DI water were added to a Mutek charge titrator. 0.001 meq PVSK solution was used as the titrant for the cationic strength resins and 0.001 meq polyDADMAC solution was used as the titrant for the anionic strength resin. The amounts of titrant used to convert the solution charge to neutral were recorded. The charge densities of the products were calculated accordingly and the results are given in Table 1.

Hand Sheet Preparation

Hand sheets were prepared using a pulp mixture of bleached hardwood and bleached softwood. Deionized water was used for furnish preparation, and additional 150 ppm of sodium sulfate and 35 ppm of calcium chloride were added. While mixing with an overhead agitator, a batch of 0.6% solids containing 8.7 g of cellulose fibers was treated with various strength agent samples (described below) that were diluted to 1% weight % with deionized water. After the addition of the strength agent, the pulp slurry was mixed for 30 seconds. Then, four 3-g sheets of paper were formed using a standard (8"×8") Nobel & Woods hand sheet mold, to target a basis weight of 52 lbs/3000 $ft^2$ (0.51 Pa). The hand sheets were pressed between felts in the nip of a pneumatic roll press at about 15 psig and dried on a rotary dryer at 110° C. The paper samples were oven cured for 10 minutes at the temperature of 110° C. then conditioned in the standard TAPPI control room for overnight.

Dry Tensile Strength Test

Tensile strength is measured by applying a constant-rate-of-elongation to a sample and recording the force per unit width required to break a specimen. This procedure references TAPPI Test Method T494 (2001), which is incorporated herein by reference, and modified as described.

Initial Wet Tensile Strength Test

This test method is used to determine the initial wet tensile strength of paper or paperboard that has been in contact with water for 2 seconds. A 1-inch wide paper strip sample is placed in the tensile testing machine and wetted on both strip sides with distilled water by a paint brush. After the contact time of 2 seconds, the strip is elongated as set forth in 6.8-6.10 of TAPPI Test Method 494(2001). The initial wet tensile is useful in the evaluation of the performance characteristics of tissue products, paper towels and other papers subjected to stress during processing or use while instantly wet. This method references U.S. Pat. No. 4,233,411, which is incorporated herein by reference, and modified as described.

Permanent Wet Tensile Strength Test

This test method is used to determine the wet tensile strength of paper or paperboard that has been in contact with water for an extended period of 30 minutes. A 1-inch wide paper strip sample is soaked in water for 30 minutes and is placed in the tensile testing machine. The strip is elongated as set forth in 6.8-6.10 of TAPPI Test Method 494(2001). A low permanent wet tensile strength indicates that the paper product can be repulped in water without significant mechanical energy or dispersed in water easily without clogging sewage systems.

RESULTS AND DISCUSSION

It has been widely accepted that GPAM performance depends on the alkalinity level in the pulp suspension. Increasing the alkalinity level typically lowers the paper strength increase from GPAM products. As shown in Table 3, with 100 ppm alkalinity at pH 7.5, 9 lb/ton FENNOBOND 3000 did not provide any strength increase. In comparison, the combination of FENNOBOND 85 and Example 2 led to both high dry tensile strength increase and high wet tensile increase. Furthermore, the strength increase depends on the weight ratio of GPAM to FENNOBOND 85. At the ratio of 1:1, the paper products showed the highest dry tensile strength and also the highest wet tensile strength. GPAM products contain aldehyde functional groups which can react covalently with APAM acrylamide functional groups. Upon mixing, cationic GPAM and APAM form strong complexes via both electrostatic interactions and also covalent interactions. As demonstrated in Table 3, this strong complex formation provided the highest strength increase at an optimal GPAM/APAM ratio.

At lower ratios, there were not enough aldehyde groups to increase paper strength. At higher ratios, there were not enough APAM to form complexes with GPAM. For the industrial applications, the conventional GPAM products were commonly applied to produce packaging and board (P&B) paper grades. The fiber resources of those grades are often recycled old corrugated container boards (OCC) which contain high filler contents and high alkalinity levels. The combination of high charge GPAM and APAM can be applied in this application to further enhance paper strength. In addition, this new program can also be applied to increase the production rate, saving the cost of a separate retention/drainage program and the associated pumping equipment.

Polyamidoamine ephichlorohydrin (PAE) resins are commonly used to increase paper wet strength. However, most commercial PAE resins contain absorbable organo-halo compounds (AOX) which are considered as carcinogens. There is a continuous effort to develop a non-PAE paper wet strength resins in the papermaking industry. The combination of high charge GPAM and APAM in this invention provides an alternative route to increase paper wet strength, particularly for the papermaking mills using recycled furnishes containing high levels of alkalinity.

TABLE 2

Charge densities of strength products

| Product | Charge density (meq/g) |
|---|---|
| Fennobond 85 | −1.29 |
| Fennobond 3000 | +0.29 |
| Sample 2 | +2.25 |

TABLE 3

Paper strength under high alkalinity. Alkalinity = 100 ppm, 50% hardwood + 50% softwood, Canadian Standard Freeness = 450 ml, pH = 7.5.

| Samples | Charge density of strength resins (meq/g) | Dry tensile (lb/in) | Dry tensile increase (%) | Initial wet tensile (lb/in) | Permanent wet tensile (lb/in) |
|---|---|---|---|---|---|
| Blank | | 20.1 ± 0.8 | NA | 0.9 ± 0.1 | 0.3 ± 0.1 |
| 9 lb/ton Fennobond 3000 | +0.29 | 19.3 ± 0.5 | 0 | 0.8 ± 0.1 | 0.5 ± 0.1 |
| 6.8 lb/ton Example 2 - 2.2 lb/ton Fennobond 85 | +1.38 | 24.1 ± 0.9 | 19.9 | 1.5 ± 0.6 | 1.4 ± 0.1 |
| 4.5 lb/ton Example 2 - 4.5 lb/ton Fennobond 85 | +0.48 | 24.5 ± 0.5 | 21.9 | 1.9 ± 0.1 | 1.7 ± 0.1 |
| 3.2 lb/ton Example 2 - 5.8 lb/ton Fennobond 85 | 0 | 23.4 ± 0.5 | 16.4% | 1.0 ± 0.1 | 0.5 ± 0.1 |

The invention claimed is:

1. A mixed composition comprising an anionic polyacrylamide (APAM), and a high charge cationic glyoxylated polyacrylamide (GPAM), wherein the high charge cationic glyoxylated polyacrylamide has a cationic charge density of over 0.6 meq/g, said mixed composition having being prepared on site for being added to a fibrous slurry or to a fibrous web in a papermaking process.

2. The composition of claim 1, wherein the anionic polyacrylamide has a molecular weight in the range of 500-60 000 000 Daltons.

3. The composition of claim 2, wherein the anionic polyacrylamide has a molecular weight in the range of 1000-1 000 000 Daltons.

4. The composition of claim 1, wherein the cationic polyacrylamide base polymer of the high charge cationic glyoxylated polyacrylamide has a molecular weight in the range of 500-1 000 000 Daltons.

5. The composition of claim 4, wherein the cationic polyacrylamide base polymer of the high charge cationic glyoxylated polyacrylamide has a molecular weight in the range of 1000-100 000 Daltons.

6. The composition of claim 1, wherein the high charge cationic glyoxylated polyacrylamide has a cationic charge density in the range of 0.4-5 meq/g.

7. The composition of claim 6, wherein the high charge cationic glyoxylated polyacrylamide has a cationic charge density in the range of 0.6-4.0 meq/g.

8. The composition of claim 1, wherein the GPAM to APAM ratio is in the range of 0.01:1-1:0.1.

9. The composition of claim 8, wherein the GPAM to APAM ratio is as in the range of 0.1:1-1:0.1.

10. The composition of claim 1, wherein the high charge cationic glyoxylated polyacrylamide comprises a cationic monomer diallyl dimethyl ammonium chloride (DADMAC).

11. The composition of claim 1, wherein the high charge cationic glyoxylated polyacrylamide comprises a cationic monomer selected from 2-vinylpyridine, 4-vinylpyridine, 2-methyl-5-vinylpyridine, 2-vinyl-N-methylpyridinium chloride, p-vinylphenyltrimethylammonium chloride, p-vinylbenzyltrimethylammonium chloride, 2-(dimethylamino) ethyl methacrylate, trimethyl(p-vinylbenzyl)ammonium chloride, p-dimethylaminoethylstyrene, dimethylaminopropyl acrylamide, 2-methylacroyloxyethyltrimethyl ammonium methylsulfate, 3-acrylamido-3-methylbutyl trimethyl ammonium chloride, 2-(dimethylamino)ethyl acrylate, [2-(acrylamido)ethyl]trimethylammonium chloride, [2-(methacrylamido)ethyl]-trimethylammonium chloride, [3-(acrylamido)propyl]trimethylammonium chloride, [3-(methacrylamido)propyl]trimethylammonium chloride, N-methyl-2-vinylpyridinium, N-methyl-4-vinylpyridinium, [2-(acryloyloxy)ethyl]trimethyl-ammonium chloride, [2-(methacryloyloxy)ethyl]trimethylammonium chloride, [3-(acryloyloxy)propyl]trimethylammonium chloride, [3-(methacryloyloxy)propyl]-trimethylammonium chloride, and combinations thereof.

12. The composition of claim 1, wherein the anionic polyacrylamide (APAM) comprises an anionic monomer selected from acrylic acid, sodium acrylate salt, ammonium acrylate salt, methacrylic acid, sodium methacrylate salt, ammonium methacrylate salt, maleic acid, sodium salt, ammonium salt, or combinations thereof.

13. The composition of claim 1, wherein the mixed composition consists of said anionic polyacrylamide (APAM), and said high charge cationic glyoxylated polyacrylamide (GPAM) in an aqueous solution.

* * * * *